United States Patent [19]

Berrenberg

[11] Patent Number: 4,879,855

[45] Date of Patent: Nov. 14, 1989

[54] ATTACHMENT AND REINFORCEMENT MEMBER FOR MOLDED CONSTRUCTION FORMS

[76] Inventor: John L. Berrenberg, 3704 Valerie, NE, Albuquerque, N. Mex. 87111

[21] Appl. No.: 183,730

[22] Filed: Apr. 20, 1988

[51] Int. Cl.[4] ..... E04C 1/08

[52] U.S. Cl. ..... 52/309.11; 52/426

[58] Field of Search ..... 52/309.2, 309.7, 309.12, 52/309.11, 373, 424, 426, 670, 671, 672

[56] References Cited

U.S. PATENT DOCUMENTS

| | | | |
|---|---|---|---|
| 880,820 | 3/1908 | Pierson | 52/670 |
| 3,552,076 | 1/1971 | Gregori | 52/309 |
| 3,788,020 | 1/1974 | Gregori | 52/309 |
| 3,872,636 | 3/1975 | Nicosia | 52/364 |
| 3,922,828 | 12/1975 | Patton | 52/368 |
| 4,223,501 | 9/1980 | DeLozier | 52/309.11 |
| 4,226,061 | 10/1980 | Day | 52/426 X |
| 4,516,372 | 5/1985 | Grutsch | 52/426 X |
| 4,604,843 | 8/1986 | Ott et al. | 52/309.12 X |
| 4,698,947 | 10/1987 | McKay | 52/426 X |
| 4,706,429 | 11/1987 | Young | 52/309.12 |
| 4,731,968 | 3/1988 | Obino | 52/309.12 |

*Primary Examiner*—Carl D. Friedman
*Assistant Examiner*—Jerrold D. Johnson
*Attorney, Agent, or Firm*—Karla Ojanen

[57] ABSTRACT

The attachment and reinforcement member for molded construction forms, as embodied herein, has a central portion of expanded webbed steel in which the ends are bent to accommodate covering strips of solid galvanized steel. The invention is embedded in a molded construction form during the form's manufacture. The strips of the solid galvanized steel extend to the outer surfaces of the form and provide attachment surfaces whereas the central portion of expanded steel web reinforces the form. The result is a molded construction form that is stronger, and one that further provides easily locatable embedded attachment surfaces for bracing means during the curing of the concrete and for finishing materials. The molded construction form has a number of galvanized steel strips, preferably ten with five on each outer surface, located at the standard building twelve inch centers, to provide surfaces for attaching any type of wall covering such as sheetrock, siding, paneling, lath for stucco, or brick veneer. These attachment strips also define the location of the vertical cavities and concrete posts within the construction form.

8 Claims, 4 Drawing Sheets

ATTACHMENT AND REINFORCEMENT MEMBER FOR MOLDED CONSTRUCTION FORMS

FIELD OF THE INVENTION

The present invention relates to the field of building construction materials and more particularly to an improved means of applying materials to the outer surfaces of and reinforcing molded construction forms.

BACKGROUND OF THE INVENTION

The advantages of using a self-supporting molded construction form in the building industry are well known in the art. These construction forms are manufactured from a polymeric material, often polyurethane or polystyrene, which expands within a mold to yield a rigid, low-density foamed plastic form having vertical and/or horizontal cavities to be filled with wet concrete. The polystyrene concrete forms typically have a tongue and groove arrangement on all sides to allow for the interlocking placement of additional forms on either side, above, and below a form as to construct a solid wall or structure. Wet concrete is poured into the construction forms which are then left in place, instead of being removed, once the concrete has cured thereby providing support for the concrete and insulation for the finished building structure. U.S. Pat. No. 3,552,076, entitled "CONCRETE FORM" to Gregori, and U.S. Pat. No. 3,788,020, entitled "FOAMED PLASTIC CONCRETE FORM WITH FIRE RESISTANT TENSION MEMBER" to Gregori both teach methods whereby polystyrene foam is molded to yield a concrete form.

The construction industry has incorporated several means of attaching finishing materials to the outer sides of these molded construction forms after the concrete within the cavities has set. One such method has been to glue the paneling, sheetrock, or other suitable finishing materials to the outer surfaces of the completed form. .Additionally, outer finishing materials may be rigidly attached using a penetrating device through the outer molded form to the dried concrete or other building material inside the form. Another method to attach finishing materials is to glue or nail furring strips on the outer surfaces of the forms. Gluing the furring strips to the foam forms require construction adhesive, and nailing the furring strips or the finishing materials to the outer sides of the forms require that special concrete nails be used. The application of these concrete nails, moreover, must be accomplished at a critical time during the curing of the concrete. Then, the finishing materials are nailed or screwed onto the furring strips.

Another method whereby materials can be mounted to a building structure has been to glue an intermediate attachment surface to the outer surface of a polymeric building structure. The adhesion of sheet metal to polyester foam beams is presented in U.S. Pat. No. 3,922,828, entitled "STRUCTURAL MEMBER" to Patton. Finishing materials are then attached by means of nails or screws to the strips of sheet metal. The disadvantages associated with this arrangement is that it is costly and time consuming to apply a continuous sheet of metal to the outer surfaces of building studs or beams. Moreover, adhesion materials are also costly and the adhesion may eventually deteriorate with the resultant separation of the finishing materials from the synthetic structural member. An alternative embodiment of the Patton invention is to embed a Z-shaped piece of steel within the polyester structural beam and to attach the finishing material to the outer surfaces with screws or other penetrating devices through the Z-shaped steel member. This means of attachment poses the difficulty of locating the steel members embedded within the structure and do not extend to the outer surfaces. A large piece of steel is required to either cover large building beams or studs, or to embed the steel within the beam or stud. This not only makes the beam or stud heavy and burdensome, but it is costly to provide such a large piece of steel in the structure.

Another method for applying materials particularly to the concrete form previously discussed is presented in U.S. Pat. No. 4,223,501, entitled "CONCRETE FORM" to DeLozier. This patent teaches a method whereby a one piece transverse connecting member is embedded in the polystyrene concrete form taught in *the Gregori* patent. The connecting member has attachment flanges extending at right angles which extend near the outer surfaces of the form, and thus are allegedly suitable for receiving fastening members penetrating the flanges. The disadvantages presented by the *DeLozier* invention include the difficulty of locating the flanges once the concrete form is in place and the concrete has been poured because the attachment flanges are positioned below the outer surface of the concrete forms. The *DeLozier* invention teaches that the attachment flanges can be located with either a template or markings on the foam units. Alternatively, the attachment flanges can be located by breaking away the foam to reveal the flanges for attachment. All of the above methods are time consuming and require additional labor.

The manufacturing costs associated with the concrete form embodied in the *DeLozier* patent, moreover, are high partially because of the one piece construction of the connecting members and extending flanges. The connecting member taught by *DeLozier* is manufactured from heavy gage steel with arcuate or polygonal holes punched in the steel, thus generating substantial waste material. The one piece construction of the connecting member and the attachment flanges, furthermore, requires that the attachment flanges be made from the same heavy gage steel as the connecting member. Practical application of the *DeLozier* invention reveals that it is difficult to screw or attach finishing materials to the form because the steel is too thick. The *DeLozier* invention uses only two of these connecting members per form unit wherein each connecting member is placed midway between the center and the edges of the form presumably because of the cost of the steel and the weight of the heavy gage steel used. The use of only two connecting members per form does not practicably yield additional strength or reinforcement of the concrete form at the weakest parts of the form which are the ends.

A device similar to the invention taught by *DeLozier* has been in use in the industry incorporating a metal connecting member, but the attachment flanges are pieces of wood, generally of a 2×2 size, embedded in the outer surfaces of the concrete form. The wooden flanges are stapled to the metal connecting member, and then the finishing materials such as sheetrock is attached to the wood as is common in the art. Two wooden attachment members are used on each outer surface of the polystyrene concrete form, and are located midway between the center and the ends of the forms. This arrangement presents several disadvantages, some of which have already been discussed. First, the use of the wooden attachment members at the two locations provides no reinforcement of the construction form at the weakest parts of the form, i.e., the ends of the form. Secondly, it is impossible to apply these wooden attachment flanges to the ends of the form because they interfere with the tongue and groove arrangement for the fitting of adjacent forms. Lastly, the stapling of the wood flanges to the central metal web portion presents a point of potential failure. The wood may easily separate from the metal web portion and, at worse, the finishing materials could separate from the outer surfaces of the construction forms.

A construction panel unit made up of solid flanges and expanded steel mesh is taught in U.S. Pat. No. 3,872,636, entitled "LIGHT WEIGHT LOAD BEARING METAL STRUCTURAL PANEL" to Nicosia. This unit is intended to provide for high strength compression and tension load sustaining surfaces in the construction of walls, ceilings, floors and the like, and is used in place of the molded construction form. It would be impossible to apply this construction panel to a molded construction form without having new molds machined to accommodate the elaborate configuration of steel mesh and steel bars embodied in the Nicosia invention. Rather, the panel presents a construction alternative to the molded construction form. The cost of fabrication of this panel, moreover, is relatively high compared to the cost of the polystyrene construction forms incorporating the features of the present invention.

SUMMARY OF THE INVENTION

It is thus an object of the present invention to provide increased strength and reinforcement to molded construction forms.

It is a further object of the invention to provide an attachment member whereby bracing means can be easily applied to the molded construction forms to hold the molds level and plumb while the concrete or other building substance cures and hardens.

It is yet another object of the present invention to provide a visual means of defining where the concrete posts are located within the construction mold.

It is yet another object of the present invention to provide an improved and more economical means for attaching finishing materials to the outer surfaces of molded construction form.

The present invention provides an improved and a more economical means of attaching materials to the outer surfaces of molded construction forms and provides additional reinforcement of the forms.

DESCRIPTION OF THE PREFERRED EMBODIMENT

Figure 3:
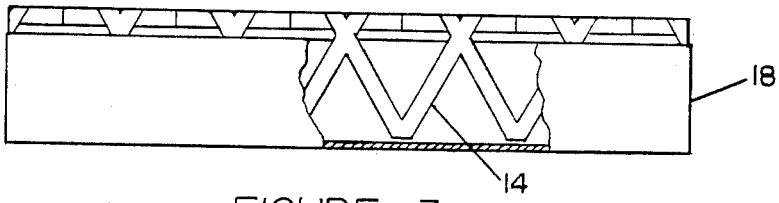
FIG. 3 is a perspective of the invention when viewed from an edge.
Figure 2:
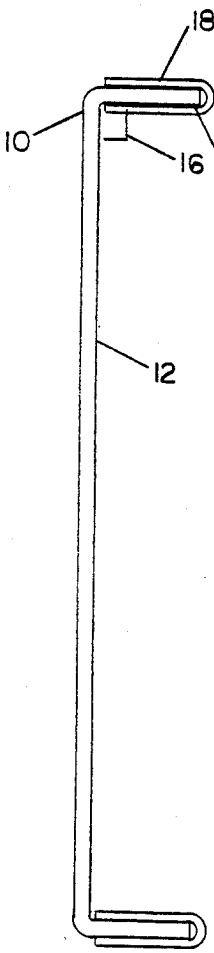
FIG. 2 is a side view of the invention.
Figure 1:
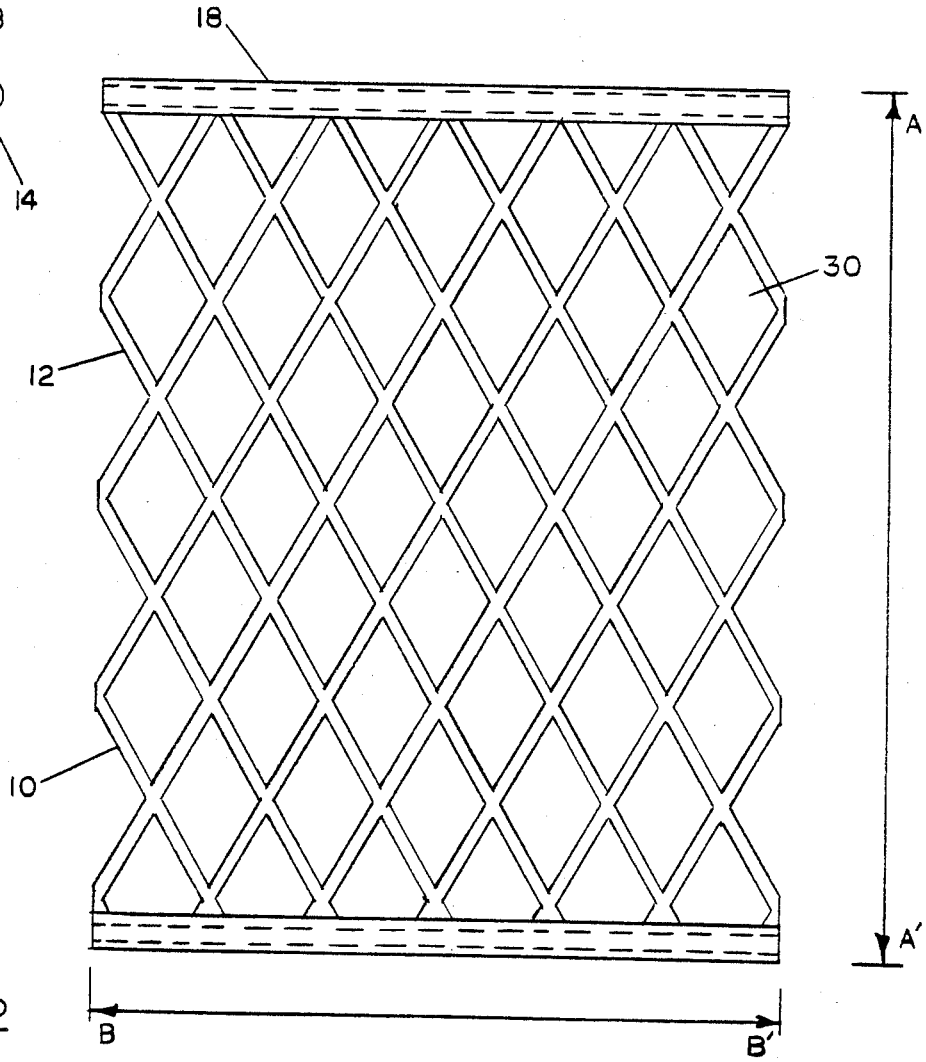
FIG. 1 is a plan view of the invention.

Referring to FIGS. 1, 2, and 3, the invention, an Attachment and Reinforcement Member for Molded Construction Forms, comprises a piece of expanded mesh 10 with a central web portion 12 and extensions 14 bent at an angle 16 and extending in the same or opposite direction at a distance determined by the application of the invention with attachment members 18 of solid galvanized steel bent snugly on either side of the extensions 14 as shown in FIG. 2. It is to be understood that while the preferred embodiment of the present invention uses an expanded metal mesh, preferably steel, as the expanded mesh, other metals, such as aluminum, or even nonmetallic substances which provide high tensile strength may also be used as the expanded mesh 10 of the invention. Likewise, the preferred embodiment of the invention uses solid metal, and most preferably, solid galvanized steel of a lighter gage than the expanded mesh 10, as the attachment member 18, but other materials with a solid surface, an appropriate thickness, and with sufficient strength characteristics may be incorporated into the present invention.

Initially, the dimensions of the flattened piece of expanded mesh 10 are nine inches by thirteen inches. The extensions 14 of the expanded mesh 10 are bent at angles 16, leaving approximately one inch at the bent extensions, and a central web portion 12 of the invention as a rectangle of approximately nine inches by eleven inches. The dimensions of the attachment members 18 are approximately ten inches by two inches. The attachment members 18 are then folded along the longitudinal axis with one inch extending from either side of the center fold and applied to the extensions 14 of the expanded mesh 10 thus covering the mesh of the extensions 14 as shown in FIG. 2. Care must be taken during the manufacture of the invention to ensure that the overall depth of the finished construction form 20, shown in FIG. 4, minus the overall dimension of the central web portion 12, the bent extensions 14, and the attachment members 18 covering the extensions 14 is between one thirty-second and one-eighth of an inch. This difference in dimensions must be slight for two reasons. If this difference does not fall within the aforementioned specifications, the metal or substance from which the expanded mesh 10 is composed, may scratch or otherwise mar the delicately machined aluminum molds when the invention is placed in the mold during the manufacture of the construction form, especially if the expanded mesh is expanded steel. The critical dimension of the invention, moreover, allows the attachment members 18 to extend to and lie within the plane of the outer surfaces 26 of the construction form 20, and are thus easily visible.

While it should be noted that the preferred embodiment of the present invention is incorporated into the molded polystyrene concrete form 20, the dimensions of the invention can be altered to accommodate its use with other types and sizes of molded construction forms. For example, for a smaller polystyrene mold the initial expanded mesh 10 may be of the dimensions nine inches by eleven inches, such that when the extensions 14 are bent at angles 16, a central web portion 12 would be a square of approximately nine inches by nine inches. Furthermore, the extensions 14 bent at angles 16 to the expanded mesh 10 may be greater than or less than one inch, and correspondingly the dimensions of the attachment members 18 may be greater or less to accommodate the changes in dimensions of the extensions 14, thereby creating a larger or a smaller attachment surface 18 on the outer surface 26 of the construction form 20. Thus, it is intended that the dimensions given are not limitations of the present invention, but rather merely provide an example of its application.

The central web portion 12, as shown in FIG. 1, is an open mesh structure, preferably provided by the expanded metal technique, well known in the art, wherein longitudinal slits are perforated in sheet metal and the metal is stretched laterally to expand the slits resulting in a uniform pattern of staggered diamond shaped longitudinal openings 30 having a longer or major axis, and a shorter or minor axis. Upon expansion of the metal, the longitudinal openings 30 are angularly configured, i.e., the side of each diamond shaped longitudinal opening along the major axis is situated above the plane of the other side. This angular arrangement of the steel mesh is common in the building industry and is suitable for the application of plaster to the steel mesh. It is also common to the specialty steel sheet industry and is generically referred to as expanded metal. The expanded metal is then preferably flattened to form the expanded mesh portion 10 of the invention. The expanded mesh portion 10, however, need not be flattened. The invention as embodied herein may accommodate the angular configuration of the central web portion 12 if the slots in the aluminum mold are sufficiently wide enough to allow for that additional depth or if replaceable inserts are placed in the mold to prevent the scratching and marring of the aluminum mold that may otherwise occur. The advantages presented by using the expanded metal technique eliminates the additional labor associated with punching the holes in the steel, and the waste resulting from the punching arcuate or polygonal holes as taught in the prior art. Furthermore, the expanded metal is readily available. The expanded mesh 10 of the central web portion 12 also facilitates the flow of the construction material which can be quite viscous, such as concrete, within the cavities 22 of the molded construction form 20 more efficiently than the flow of wet concrete through the polygonal or arcuate holes embodied in the prior art.

As mentioned, it is preferred that the attachment members 18 are constructed from a solid piece of a lighter gage of steel than is required for the central expanded steel mesh portion 10 of the invention. This arrangement is advantageous because the lighter gage steel is less expensive than the heavier gage steel used in the prior art, and the lighter gage steel is readily available in the building industry. The heavier steel construction of these devices taught in the prior art, moreover, makes penetration of the steel more difficult and, of course, more time consuming for the construction worker. The present invention overcomes this disadvantage of the prior art by providing a lighter gage steel surface for attachment making it easier to screw or otherwise apply materials to the finished form. The lighter gage steel of the attachment members, moreover, provides sufficient strength to function as a load bearing unit to support the finishing materials.

Figure 4:
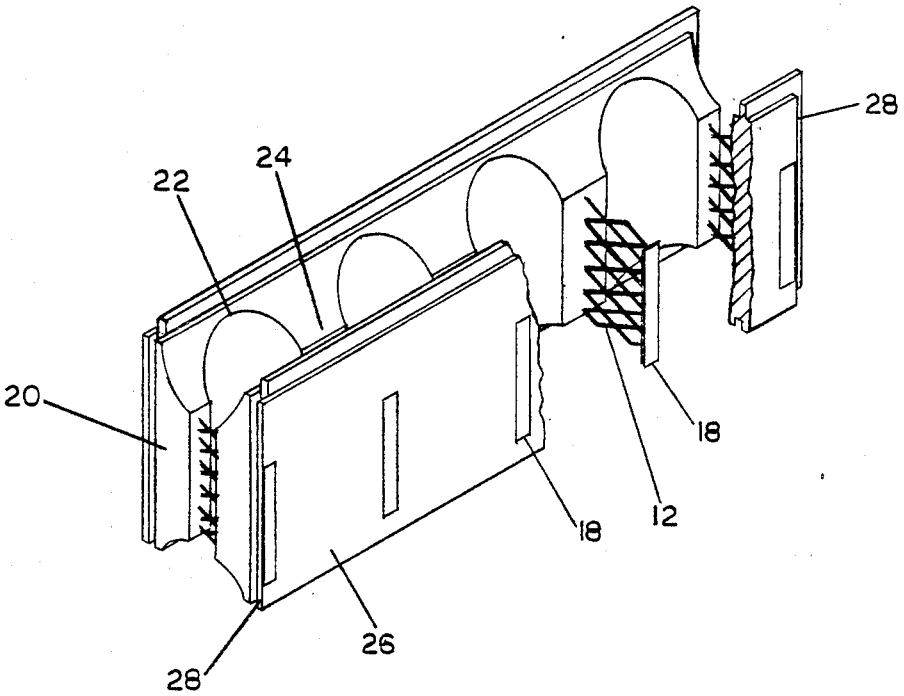
FIG. 4 illustrates the invention incorporated into a construction form, with a portion of the outer surface of the form cut away for demonstrating the placement of the invention.

The attachment members 18, shown in FIGS. 2 and 3, are folded over the extensions 14, rather than integrally attached to the extensions 14. This means of attachment presents several advantages over the prior art in which the attachment flanges are integrally connected with the a heavier steel and are manufactured from steel of the same gage. First, by merely folding the attachment members 18, one does not have to spot weld or otherwise go through a time consuming and costly process required for integral construction. Another advantage of the present invention addresses the orientation of the diamond-shaped longitudinal openings 30 within the central web portions 12 resulting from avoiding the integral construction of the cross members and attachment flanges presented in the prior art. In FIG. 1, note that the major axis of the diamond-shaped longitudinal openings 30 are parallel to the line A—A′ and are perpendicular to the line B—B′. If the invention were to use an integral construction technique whereby the interior portion of a solid piece of steel were slit and then expanded leaving extensions 14, the orientation of the diamond-shaped longitudinal openings 30 would be rotated, and the major axis of the openings would be parallel to the line B–B′. Additional strength is obtained by orientation of the major axis of the diamond-shaped longitudinal openings 30 along A–A′ because the expanded mesh 10 has greater resistance to forces applied normally along B–B′ than along A–A′. Note that when the invention is embedded in the construction form 20, as shown in FIG. 4, the orientation of the major axis of the diamond-shaped longitudinal openings 30 is perpendicular to the plane of the outer surfaces 26 of the form 20. When the construction forms 20 are stacked one upon the other for storage or shipping, stresses are applied along the line B–B′ which provides greater resistance to compression and other forces than if the diamond-shaped longitudinal openings 30 were along axis A–A′.

FIG. 4 illustrates the incorporation of the invention into a construction form 20. During manufacture of the construction form 20, the invention comprising the central web portion 12, with the extensions 14 of expanded mesh 10 bent away from the central web portion 12 and covered by the folded attachment members 18 of solid galvanized steel are placed in the grooves of the mold of the construction form 20. In the preferred case of using an expanded polystyrene concrete form, the molds are closed and polystyrene beads are injected. The polystyrene beads expand around the invention and embed the present invention within the finished construction form 20, as shown in FIGS. 4, 5, 6, and 7. The attachment members 18 extend to the outer surfaces 26 of the molded construction form 20. As can be seen in FIGS. 4 and 6, the attachment surfaces presented by the embedded attachment members 18 are easily visible. A template or otherwise marking the finished construction forms 20 to locate the attachment surfaces as taught in the prior art becomes unnecessary, and the present invention eliminates the costs of the required template and the labor associated with its use or otherwise locating the attachment surfaces. The attachment members 18 also visually define vertically where the concrete posts are located in the finished structure because the center of the concrete posts are located in the form cavity midway between each of the attachment members 18, shown at 22 in FIGS. 4, 5, and 7. This allows for a simplified means of locating where wall or adjoining floor members may be anchored into the concrete posts.

Figure 5:
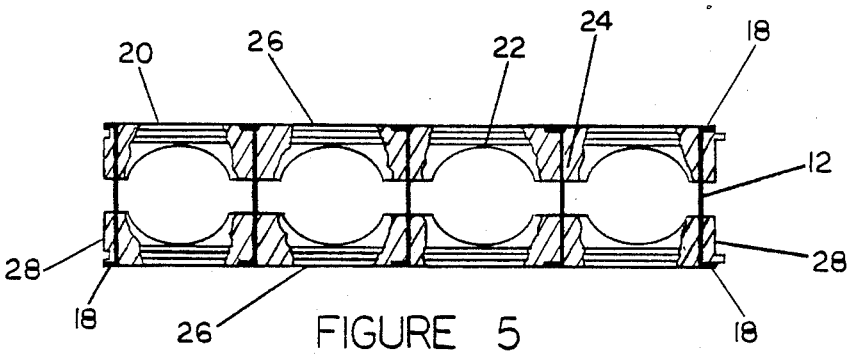
FIG. 5 is a plan view of the invention incorporated into a construction form.
Figure 6:
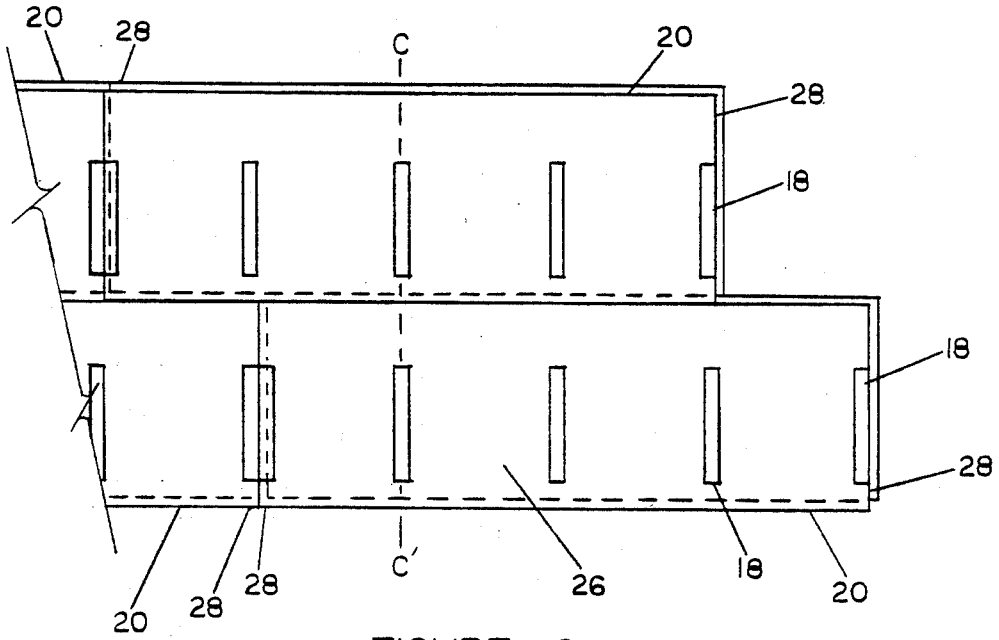
FIG. 6 is a side view of the construction form and illustrates the stacking of the construction form and the attachment surfaces provided by the invention.

Most preferably, the present invention is inserted in five positions of the molded polystyrene concrete mold 20, i.e., at each end 28 of the form and at each of the three interior ribs 24 within the molded polystyrene concrete form 20 shown in FIGS. 4 and 5. This placement of the invention provides increased reinforcement and added strength of the form 20, especially at the ends 28 of the form which are the weakest parts of the structure. The use of the Attachment and Reinforcement Member in the five placement positions strengthens the construction form 20 to withstand the strain and stress that occur during the pouring, settling, and curing of wet concrete. The construction form 20 incorporating the present invention is at least two times as strong as any other form presented by the prior art.

The attachment members 18, moreover, are conveniently located at the ends 28 and are placed in the center of each rib 24, at intervals of the building standard of twelve inch centers per construction form 20. Each of the attachment members 18 offers an attachment surface area, as shown in FIG. 4. The use of the present invention provides one hundred and fifty percent more attachment surfaces for finishing materials to the construction form 20 than as taught in the prior art. As shown in FIG. 5, the attachment members 18 all project towards the left side of the drawing, except for the unit placed at the far right end 28 of the form 20. At these ends 28, where the tongue of the form 20 extends to mate with the groove of the adjacent form 20, the invention projects to the right in the drawing. When the forms 20 are fit together, as shown in FIG. 6, by matching the tongues of one form with the grooves of the adjacent form, an effective attachment surface of two inch width is provided at the matching ends 28 by reversing the projection of this last unit.

Figure 7:
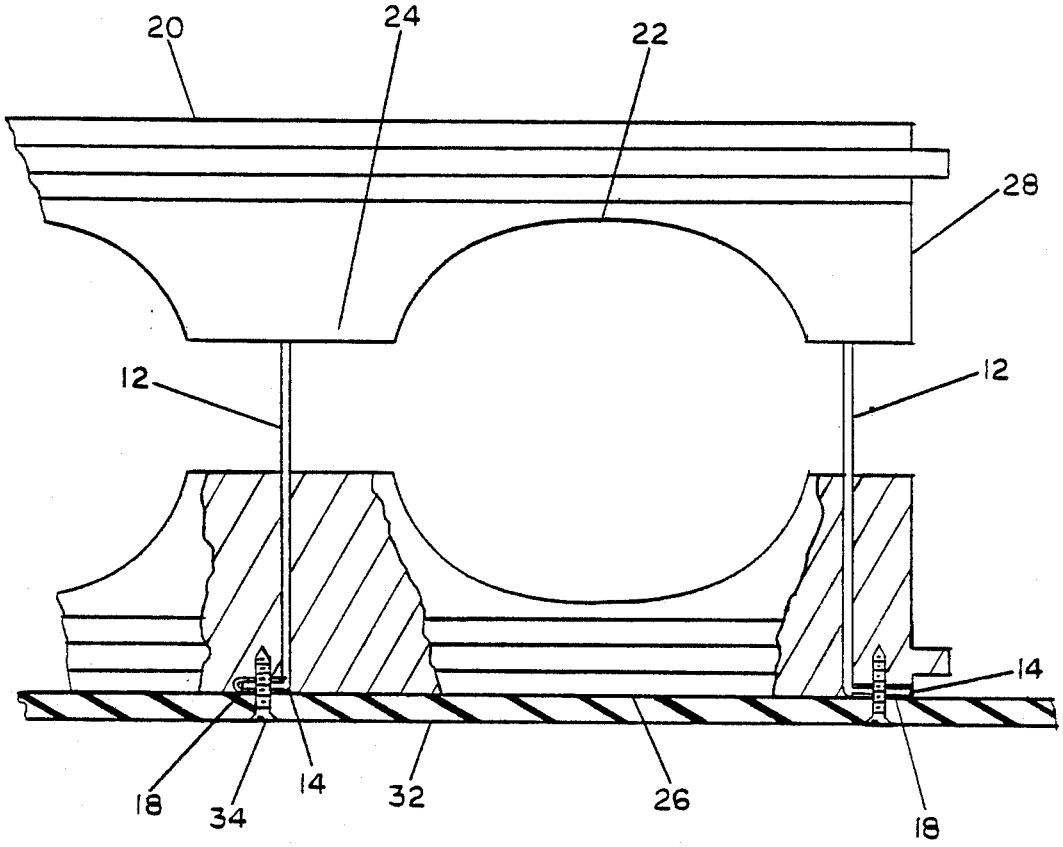
FIG. 7 is an enlarged view of FIG. 5 showing a cutaway portion of the construction form incorporating the invention and the attachment of a finishing material to the construction form.

The figures, FIGS. 2, 5, and 7, depict the extensions 14 in a channel configuration. One extension 14, however, may be bent in an opposite direction from the other extension 14, such that the angle 16 at which one extension 14 is bent will be substantially ninety degrees relative to the central web portion 12, while the angle 16 of the extension 14 at the opposing end will be substantially two hundred seventy degrees relative to the central web portion 12, in an essentially Z-shaped configuration. The projection of each attachment member 18, as shown in FIG. 5, moreover, need not all be in the same direction. Thus, any one or more of the attachment surfaces 18 may project in any direction and may be channel- or Z-shaped so long as the attachment member 18 does not interfere with the tongue and groove arrangement of the construction forms 20.

It is important to note that there are five such units used in the polystyrene molded concrete form 20 because that is the number of grooves in the premanufactured molds of this particular construction form 20. The invention may be adapted for use with any construction molds, and the number and dimension of the units is determined by the number of grooves in the molds, by the preferred building interval, and the number required to hold the construction form 20 together. Thus, if only three units of the present invention were placed in the polystyrene molds, one on each end 28 and one at the center rib 24, the attachment and bracing surfaces would be located at twenty-four inch centers. Some molds allow for sixteen inch building centers. European and foreign construction forms have standard building increments based upon the metric system. Thus, the design of the mold and the resulting construction form 20 will determine the number and dimension of the present invention used and incorporated into the form 20.

During construction of a building structure, the forms 20 are placed in a staggered and layered arrangement shown in FIG. 6. It is preferred that the form 20 that is placed above the underlying form 20 be offset at a distance of at least one integral number of the attachment and reinforcement member. In this fashion, the attachment members 18 are right above or below the attachment member 18 of the adjacent form 20, as along line C–C' shown in FIG. 6. This placement not only permits alignment of the attachment members 18 along the building increments, but more importantly, allows alignment of the concrete cavities 22, which is essential to the structural strength of the concrete structure being built. Wet concrete is then poured into the cavities 22 of the forms 20, directly from a concrete truck or more conveniently with a hose from a concrete pump for better control. After a sufficient length of time while the concrete is allowed to set up, another tier of construction forms 20 is built upon the previous and concrete is again poured. It is necessary to provide a bracing means, usually straps, wires or a rigid material, to maintain the construction forms 20 plumb, level, and straight while the concrete is poured into the forms 20 and while the concrete sets up. The attachment members 18 provide an easily locatable and a strong surface to attach the bracing means to the construction forms 20 while the concrete is poured and sets up.

FIG. 7 is an enlarged view of a construction form 20 incorporating the present invention. In this view, finishing material 32 has been applied to the outer surfaces 26 of the construction form 20 through the attachment member 18 by a screw or other penetrating device 34. The steel web cross member 12 reinforces the construction form 20 at each rib 24 and at the ends 28 of the form 20. The extensions 14 of the invention are shown covered with the attachment members 18 which extend to the outer surfaces 26 of the form 20. A penetrating device 34, such as a screw or nail, is shown, and penetrates and extends through the finishing material 32 and both sides of the folded piece of galvanized steel comprising the attachment member 18. If necessary, more than one penetrating device 34 can be applied to each attachment member 18. Those skilled in the art will appreciate the ease with which these attachment members 18 can be located, and because, in the preferred embodiment of the invention, the attachment members 18 are of a lighter gage steel than the central web portion 12, the ease with which the penetrating device 34 can be applied.

I claim:

1. In a molded construction form having two sidewall members of rectangular configuration having horizontal and vertical edges, and each of said members having a respective inner surface and a planar outer surface, comprising in combination:

(a) a plurality of cross members of expanded material with at least one angularly extending end, transversely connecting between said sidewall members, and (b) a plurality of attachment surfaces, U-shaped in a side elevation, embracing said angularly extending end, forming a uniform continuous planar surface, coplanar with said outer surface of said sidewall member.

2. The combination of claim 1, wherein said attachment surfaces are a lighter gage material than said cores members.

3. The combination of claim 1, wherein said expanded material has rhomboid openings with major and minor axes, and wherein the orientation of each major axis is transverse to said attachment surfaces.

4. The combination of claim 3, wherein said cross members have two angularly extending ends, and said attachment surfaces embrace said angularly extending ends.

5. The combination of claim 1, wherein said cross members connect between said sidewall members at each vertical edge and at predetermined distances along the length of said construction form, and wherein said attachment members are located at each lengthwise edge and at predetermined distances along said outer surface to enable mechanical of building materials on said outer surface of said sidewall members.

6. In a molded construction form having two sidewall members of a rectangular configuration having horizontal and vertical edges, and each of said members having a respective inner surface and a planar outer surface, comprising in combination:

(a) a plurality of expanded metal cross members having rhomboid openings with major and minor axes, and two angular extensions, wherein said cross members are embedded in and transversely interconnect said sidewall members; and (b) a plurality of metal attachment surfaces U-shaped in a side elevation embracing said angular extensions of said cross members forming a uniform continuous planar surfaces, in which the orientation of said major axis of rhomboid openings of said expanded metal mesh is substantially transverse to said attachment surfaces, and said attachment surfaces are of a lighter gage metal than said cross members, and said attachment surfaces extend to and are substantially coplanar with said outer surface of said sidewall members in a parallel relationship.

7. The combination of claim 6, wherein said metal is steel.

8. The combination of claim 6, wherein said cross members interconnect said sidewall members at each vertical edge and at predetermined distances along the length of said construction form, and wherein said attachment members are also located at each lengthwise edge and at predetermined distances along said outer surface to enable mechanical attachment of building materials on said outer surface of said sidewall members.

* * * * *